US011969087B1

(12) United States Patent
Kayali

(10) Patent No.: US 11,969,087 B1
(45) Date of Patent: Apr. 30, 2024

(54) GEOMETRIC WORKSPACE SYSTEM

(71) Applicant: Molham Kayali, Anaheim, CA (US)

(72) Inventor: Molham Kayali, Anaheim, CA (US)

( * ) Notice: Subject to any disclaimer, the term of this patent is extended or adjusted under 35 U.S.C. 154(b) by 0 days.

(21) Appl. No.: 17/896,079

(22) Filed: Aug. 26, 2022

(51) Int. Cl.
*A47B 87/00* (2006.01)
*A47B 21/06* (2006.01)

(52) U.S. Cl.
CPC ..... *A47B 87/002* (2013.01); *A47B 21/06* (2013.01); *A47B 2021/066* (2013.01)

(58) Field of Classification Search
CPC . A47B 2087/004; A47B 87/002; A47B 21/06; A47B 2021/066
USPC ..... 108/50.02, 64, 66
See application file for complete search history.

(56) References Cited

U.S. PATENT DOCUMENTS 2,970,874 A * 2/1961 Honeycutt ..... A47B 63/06 312/285
3,267,881 A * 8/1966 Saggione ..... A47B 13/10 108/59
3,342,147 A * 9/1967 Shettles ..... A47B 87/002 108/186
3,685,664 A * 8/1972 Kramer ..... A47F 5/02 108/189
3,698,104 A * 10/1972 Sutton ..... A47B 41/00 434/432
3,858,528 A * 1/1975 Petersen ..... A47B 87/002 312/196
4,378,727 A * 4/1983 Doss ..... F24F 7/08 108/50.13
4,706,572 A * 11/1987 Priesemuth ..... B25H 1/00 108/66
4,732,088 A * 3/1988 Koechlin ..... A47B 87/002 108/185
4,836,114 A * 6/1989 Cohen ..... A47B 13/023 108/77
5,065,832 A * 11/1991 Mark ..... A47B 21/06 108/50.13
5,438,937 A * 8/1995 Ball ..... A47B 87/002 D6/687
5,483,900 A * 1/1996 Elzenbeck ..... A47B 13/021 108/157.17
5,522,324 A * 6/1996 van Gelder ..... A47B 37/00 108/50.02
5,655,822 A * 8/1997 Roberts ..... A47B 87/002 108/50.01
5,660,120 A * 8/1997 Sims ..... A47B 21/06 49/70

(Continued)

FOREIGN PATENT DOCUMENTS

EP 2439025 A1 * 4/2012 ..... B23Q 16/008

*Primary Examiner* — Jose V Chen
(74) *Attorney, Agent, or Firm* — Plager Schack LLP; Mark H. Plager; Alexis Saenz

(57) ABSTRACT

A workspace environment system includes a plurality of desks connected to each other at a central hub of a cubicle cluster. Walls or dividers from adjoining cubicles are connected at obtuse angles from the central hub. The adjoined cubicles may be mobile. For example, the cubicle cluster may be rotated so that a user has readily available access to any of the desks in the cluster. The central hub is rotatable so that electronic connections used by the different desks in the cluster may be housed in a central point without being twisted or tangled when the cluster is rotated. Some embodiments include motorization of the central hub to rotate.

5 Claims, 5 Drawing Sheets

(56) References Cited

U.S. PATENT DOCUMENTS 5,673,632 A * 10/1997 Sykes ..... A47B 21/06 108/50.02
D388,639 S * 1/1998 Dormon ..... D6/696.3
5,715,760 A * 2/1998 Frascaroli ..... A47B 13/06 312/265.5
5,842,425 A * 12/1998 van der Aa ..... A47B 87/002 108/103
5,899,025 A * 5/1999 Casey ..... E04B 2/7453 108/50.02
5,943,966 A * 8/1999 Machado ..... A47B 87/002 248/188.9
5,988,077 A * 11/1999 Balderi ..... A47B 87/002 248/188
6,024,024 A * 2/2000 Favaretto ..... A47B 17/00 108/50.02
6,158,358 A * 12/2000 Prendergast ..... A47B 87/002 108/161
6,161,487 A * 12/2000 Chang ..... A47B 21/00 108/50.01
6,170,410 B1 * 1/2001 Gioacchini ..... A47B 87/002 108/50.01
6,283,043 B1 * 9/2001 Stern ..... A47B 21/00 108/50.02
6,360,675 B1 * 3/2002 Jones ..... A47B 9/00 108/50.02
6,382,109 B1 * 5/2002 Novikoff ..... A47B 87/002 108/65
6,553,730 B1 * 4/2003 Mueller ..... E04B 2/7433 439/654
7,357,086 B2 * 4/2008 Petrick ..... A47B 21/00 108/50.02
7,827,920 B2 * 11/2010 Beck ..... A47B 83/001 108/50.01
9,834,946 B2 * 12/2017 Shukla ..... E04H 1/06
9,883,737 B2 * 2/2018 Lanphear ..... A47B 21/02
10,882,699 B1 * 1/2021 Wang ..... A63G 33/00
2003/0183134 A1 * 10/2003 Jackson ..... A47F 9/00 108/64
2005/0092215 A1 * 5/2005 Nien ..... A47B 21/00 108/65
2007/0251428 A1 * 11/2007 Mead ..... E04B 2/7422 108/50.02
2008/0295743 A1 * 12/2008 Beam ..... A47B 37/00 108/50.02
2011/0309659 A1 * 12/2011 Beauchamp ..... A47C 1/12 108/22
2014/0007799 A1 * 1/2014 Nasseri ..... A47B 13/088 428/80
2015/0028633 A1 * 1/2015 Stubbs ..... A47B 87/002 108/106
2016/0095433 A1 * 4/2016 Cho ..... A47B 83/001 108/50.02
2020/0128951 A1 * 4/2020 Anderson ..... A47B 21/02
2020/0345137 A1 * 11/2020 Spyridopoulos ..... A47F 10/06

* cited by examiner

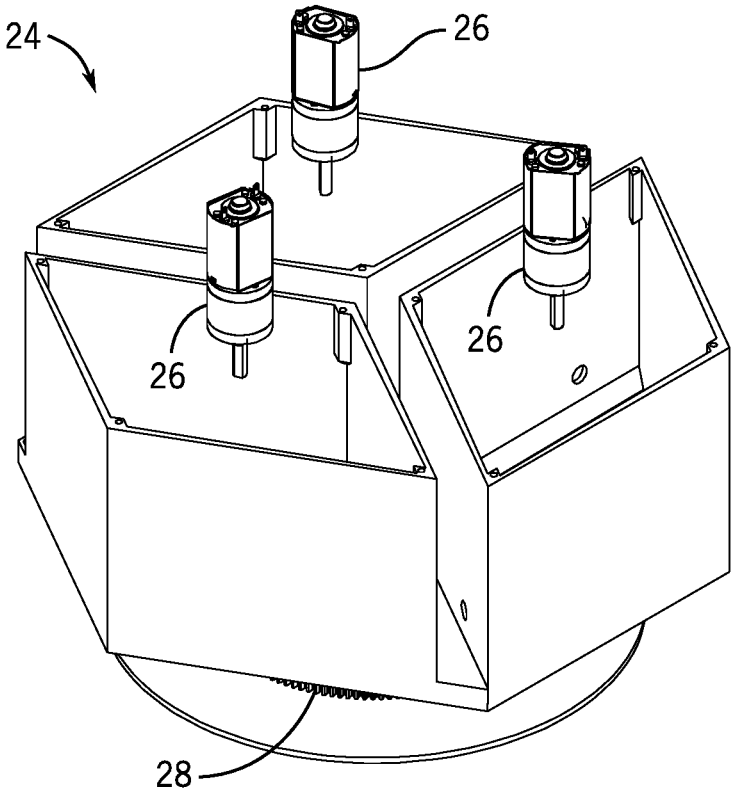
FIG. 6
FIG. 7
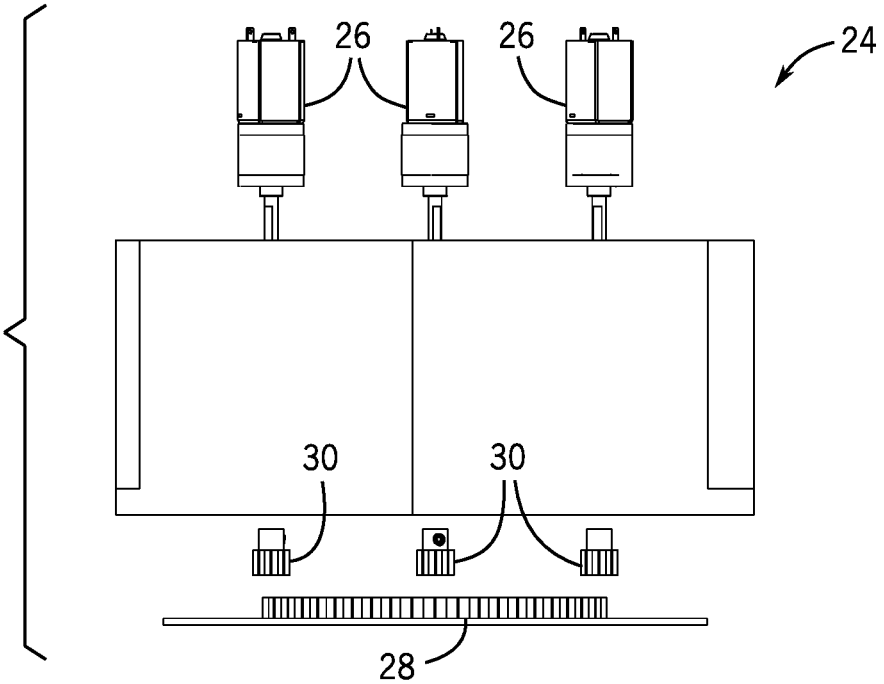

GEOMETRIC WORKSPACE SYSTEM

CROSS-REFERENCE TO RELATED APPLICATIONS

None.

BACKGROUND

The embodiments herein relate generally to automated furniture systems, and more particularly to a geometric workspace system.

Traditional workspaces do not utilize geometric space in an efficient way resulting in wasted working area. For example, traditional desks and cubicles only allow use of one work surface at a time. Storage is usually a separate system or product. Similar products waste space as living and working spaces become increasingly smaller. Additionally, with traditional workspaces, switching between tasks and their appropriate equipment wastes time and distracts workers from their potential productivity. Embodiments of the subject technology address these problems.

SUMMARY

In one aspect of the subject technology, a furniture system for efficiently using workspace area is provided. The system includes a plurality of desks. The plurality of desks include at least three desks. A hub is positioned centrally between the plurality of desks. The desks are coupled to the hub. A conduit in the hub is configured to receive electrical wiring used by electrical components on the respective desks. A mover is coupled to at least one of the desks. The plurality of desks are configured to rotate around the hub via the mover.

In another aspect of the subject technology, a furniture system for efficiently using workspace area is provided. The system includes a first cluster of desks. A first hub is positioned centrally between the first cluster of desks. The desks in the first cluster of desks are coupled to the first hub. A first conduit in the first hub is configured to receive electrical wiring used by electrical components on the respective desks of the first cluster of desks. A first mover is coupled to at least one of the desks of the first cluster of desks. The first cluster of desks are configured to rotate around the first hub via the first mover. A second cluster of desks is positioned adjacent the first cluster of desks. A second hub is positioned centrally between the second cluster of desks. The desks in the second cluster of desks are coupled to the second hub. A second conduit in the second hub is configured to receive electrical wiring used by electrical components on the respective desks of the second cluster of desks. A second mover is coupled to at least one of the desks of the second cluster of desks. The second cluster of desks are configured to rotate around the second hub via the second mover. One of the desks of the first cluster of desks is positioned adjacent to one of the desks of the second cluster of desks for a user to access one of the desks of the first cluster of desks and simultaneously access the one of the desks of the second cluster of desks.

BRIEF DESCRIPTION OF THE FIGURES

The detailed description of some embodiments of the invention is made below with reference to the accompanying figures, wherein like numerals represent corresponding parts of the figures.

FIG. 6 is an enlarged exploded view of a driver system for the system of FIG. 1 according to an embodiment of the subject technology.

FIG. 7 is a side view of the system of FIG. 6 according to an embodiment of the subject technology.

DETAILED DESCRIPTION OF CERTAIN EMBODIMENTS

Figure 1:
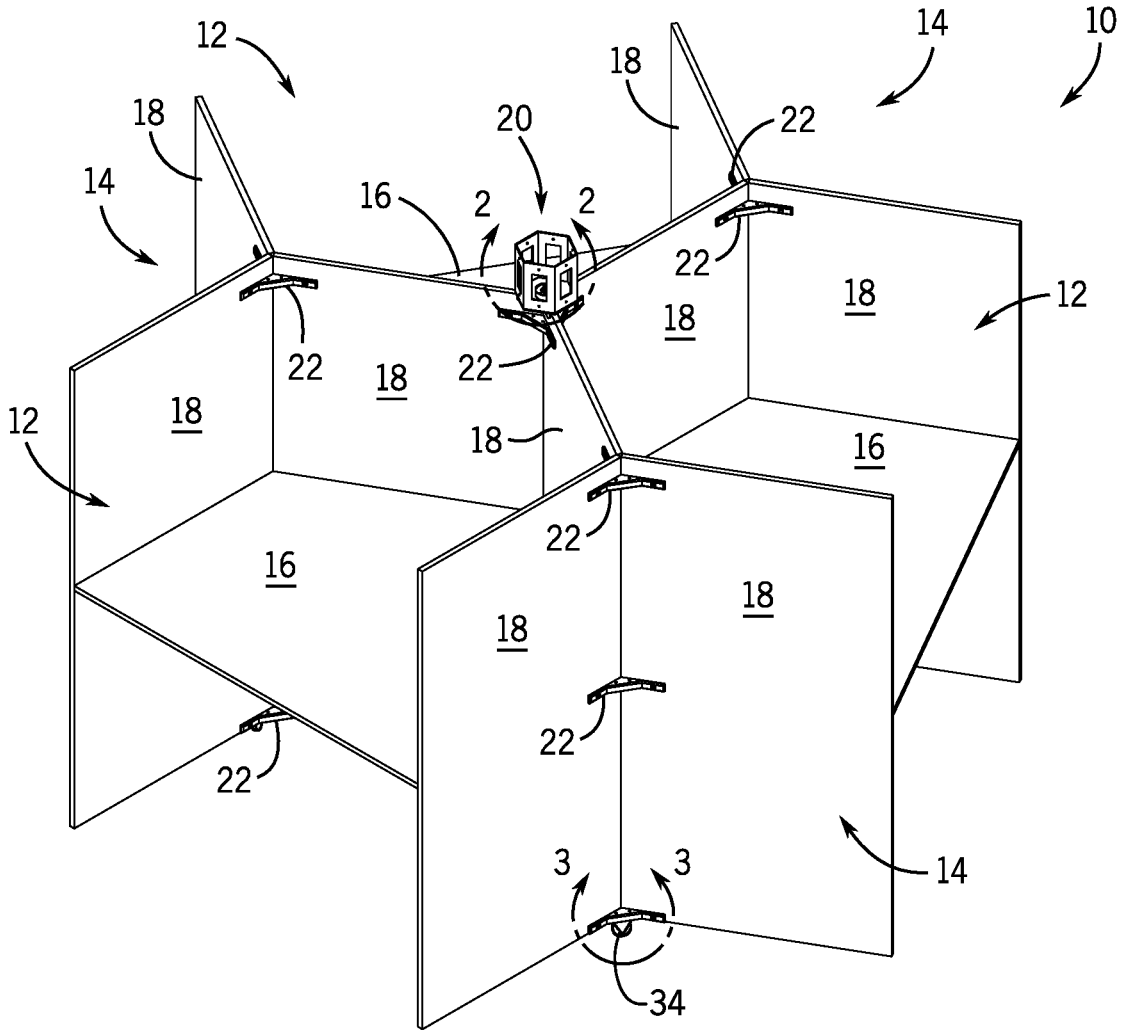
FIG. 1 is a perspective top view of a geometric workspace system according to an embodiment of the subject technology.
Figure 2:
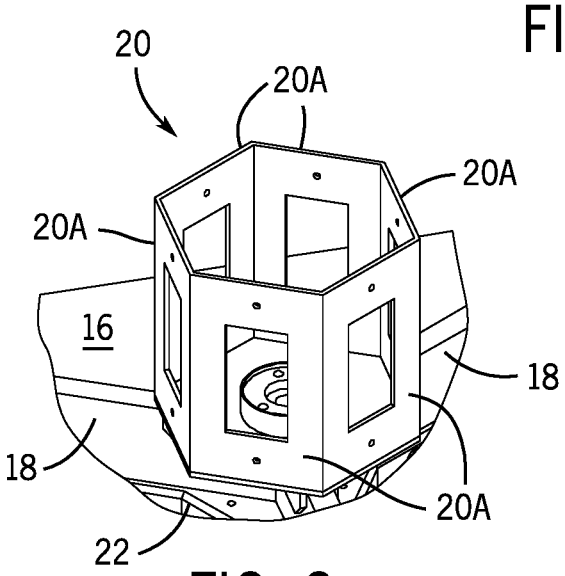
FIG. 2 is an enlarged view of the circle 2 of FIG. 1 according to an embodiment of the subject technology.
Figure 3:
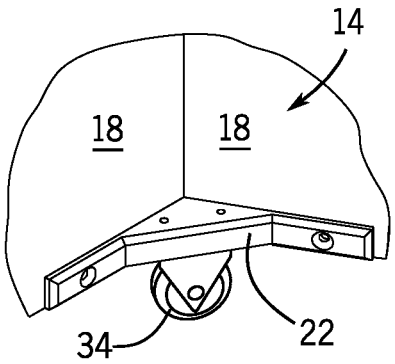
FIG. 3 is an enlarged view of the circle 3 of FIG. 1 according to an embodiment of the subject technology.
Figure 4:
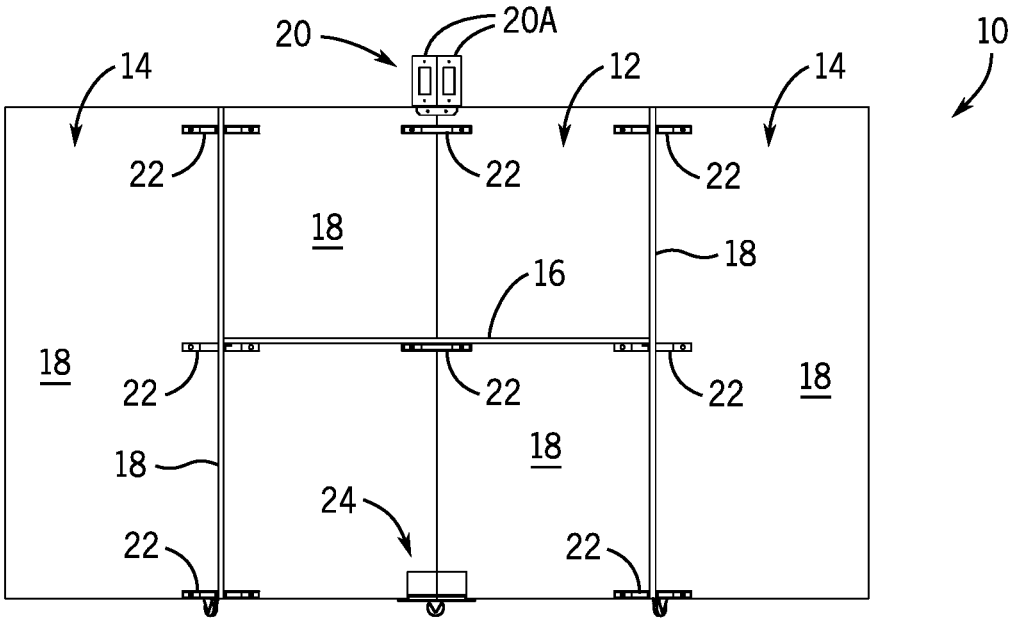
FIG. 4 is a side view of the system of FIG. 1 according to an embodiment of the subject technology.

In general, embodiments of the disclosed subject technology provide a system including a plurality of desks connected to each other at a central hub of a cubicle cluster. While the term "cubicle" is used throughout, this term should not be used to infer that the shape of any structure is limited to cubes. In an illustrative embodiment, walls from adjoining cubicles may be connected at obtuse angles from the central hub. The adjoined cubicles may be mobile. For example, the cubicle cluster may be rotated so that a user has readily available access to any of the desks in the cluster. In an illustrative embodiment, the central hub is rotatable so that electronic connections used by the different desks in the cluster may be housed in a central point without being twisted or tangled when the cluster is rotated. Some embodiments include motorization of the central hub to rotate. In an illustrative embodiment, a workspace unit comprises three desk spaces separated by the adjoining walls. As will be appreciated, the arrangement of adjoining cubicles may provide cooperating walls of two adjoined workspaces that may be used for storage, thus creating three storage space areas for each system outside of the desk areas. Three different cluster units may be positioned together so that a user at the center of the three cluster units may rotate around and face a different desk or storage area from a different unit. In addition, the individual units may be rotated so that the user at the center of clusters has access to multiple desks from multiple cluster units. As will be appreciated, the features of the system provide a scalable workspace environment. Moreover, the arrangement of desks efficiently uses the footprint of workspace in a room so that a user can access desks and use desk laden elements for readily instead of having to move around between different cubicles and desks.

Referring now to the Figures, FIGS. 1-5 show a system 10 for efficiently using workspace area. The system 10 may be for example, a cluster of desks 16. In an illustrative embodiment, the cluster of desks includes at least three desks 16. Each desk 16 may be part of a cubicle 12. The cubicles 12 may include partitions 18 (sometimes called "dividers") on each end of a desk 16 (for example, the left and right ends). The system 10 may include a centrally positioned hub 20. The hub 20 may be configured to receive electrical wiring used by electrical components on the respective desks. Each cubicle 12 or desk 16 may be coupled to the hub 20. The cubicles 12 may include a mover 34. In an illustrative embodiment, the desks 16 may rotate around the hub 20 on the movers 34.

A "mover" as used in the disclosure herein may be a device that moves things or helps facilitate movement of a thing. Examples of "movers" as used herein include for example, wheels, casters (wheeled or flat), rollers, bearings, or tracks. As will be understood, other devices that move things may be used within the scope of embodiments discussed herein. In addition, some of the aforementioned movers may be referred to by other labels. Operation of the hub 20 to rotate on the movers 34 may be provided by an electronic control system. For sake of illustration, embodiments of control systems are not shown. However, a control system for use with the subject technology may include for example, a wireless based system that includes a mobile computing device (for example, a computer, computing tablet, smartphone or other wireless computing device) loaded with a software application and a wireless receiver coupled to wiring connected to a motor assembly 24 as disclosed in further detail below. Or the control system may include a wired embodiment that includes a touchscreen computing device wired to the hub 20 and connected to the motor assembly 24. Or the touchscreen device may be connected to a chair sat in by the user and wirelessly in communication with the motor assembly 24. Accordingly, as one of ordinary skill in the art may understand, there are variations available to control the system 10 that are within the scope of the embodiments discussed herein.

Figure 5:
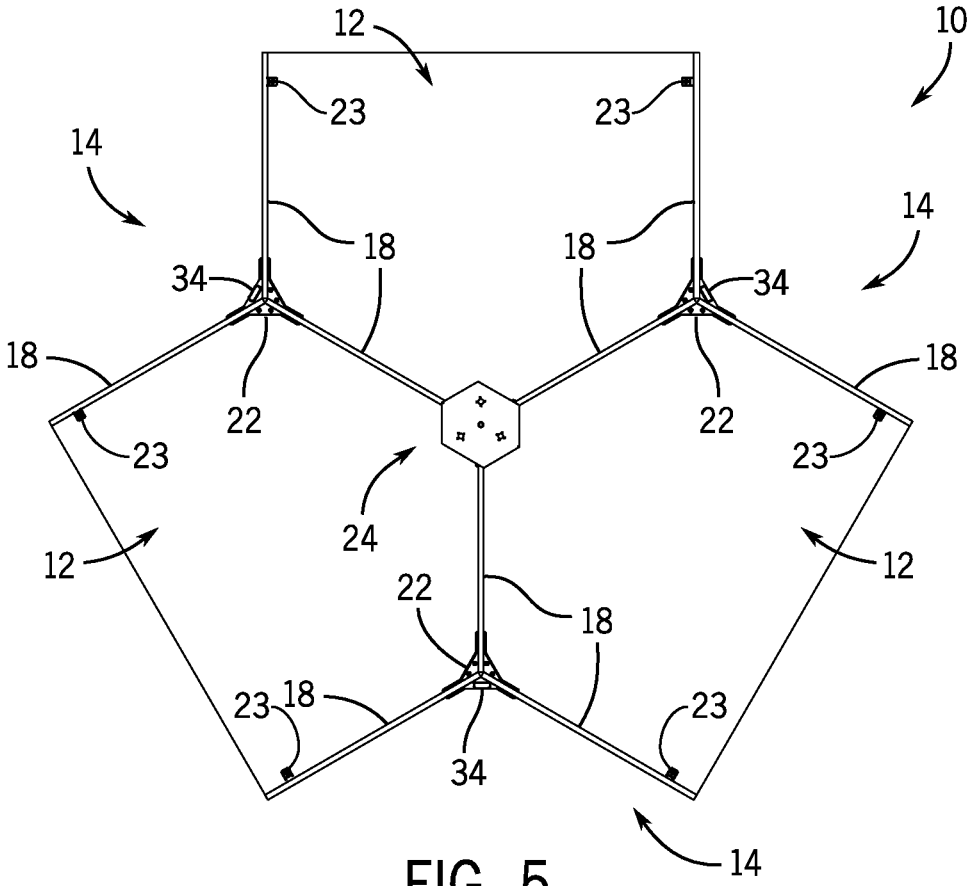
FIG. 5 is a bottom view of the system of FIG. 1 according to an embodiment of the subject technology.
Figure 8:
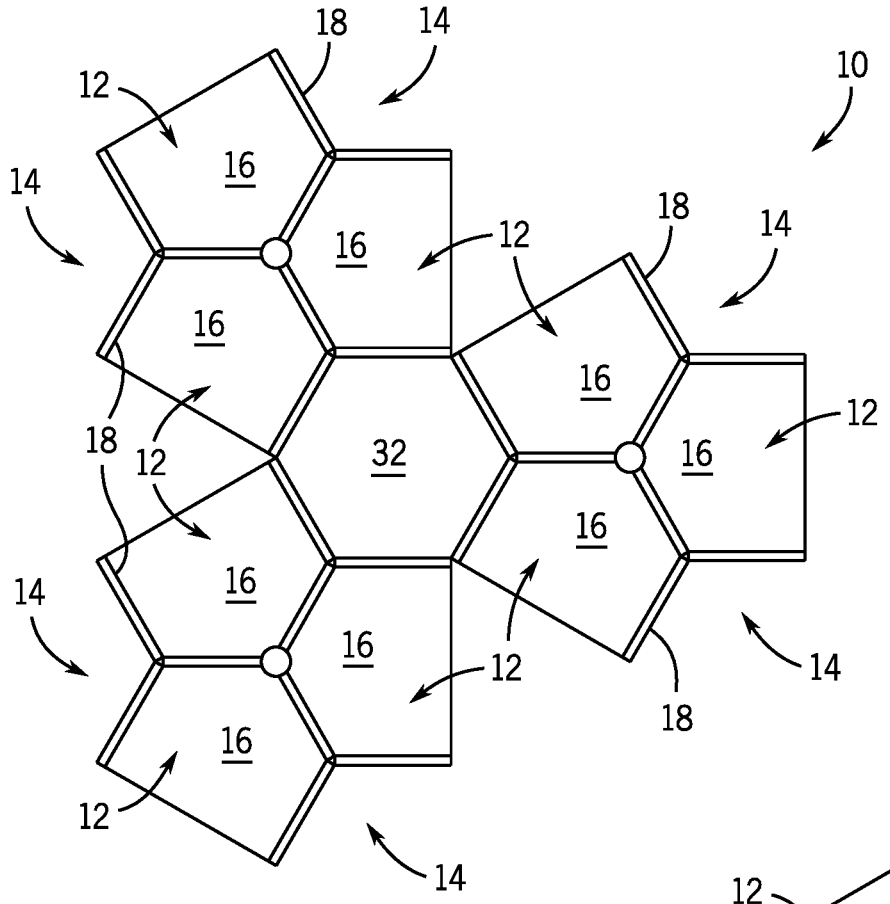
FIG. 8 is a top view of multiple systems of FIG. 1 arranged to provide simultaneous access to multiple desks according to an illustrative arrangement of the subject technology.
Figure 9:
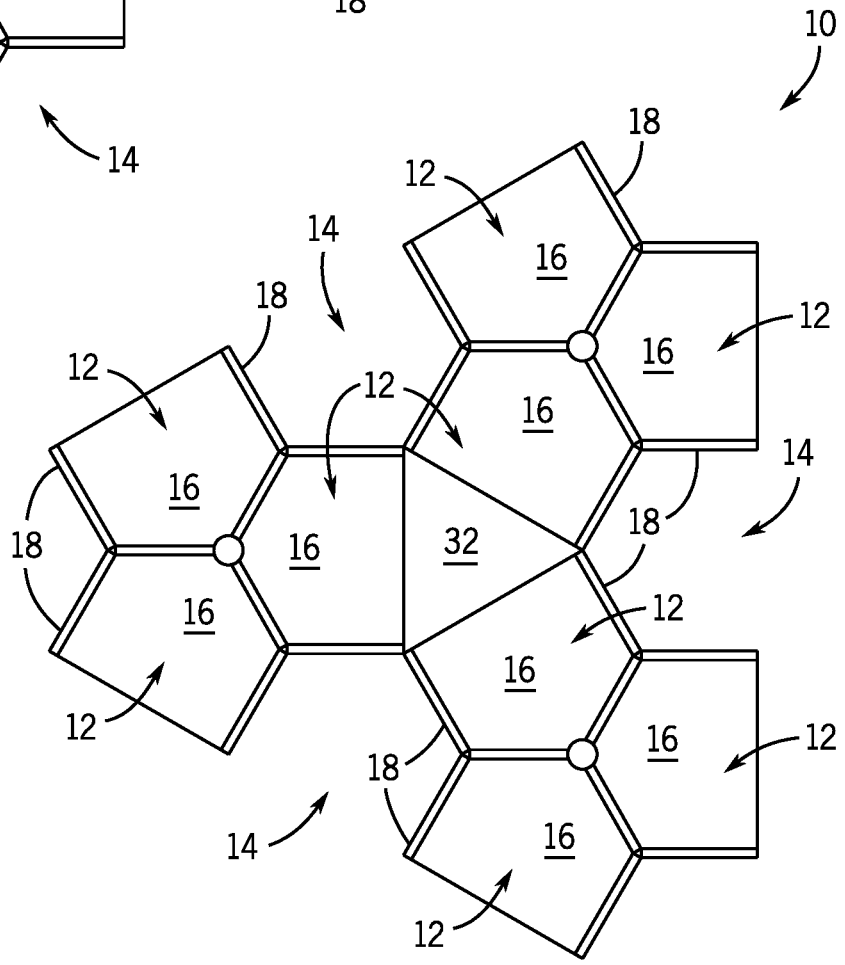
FIG. 9 is a top view of multiple systems of FIG. 1 arranged to provide simultaneous access to multiple desks after rotation according to another illustrative arrangement of the subject technology.

The front of each desk (for example, the edges opposite the edge a user would sit in front of), may include a pair of edges. The pair of edges may be coupled to the hub 20. In one embodiment, the pair of edges are arranged in an obtuse angle relative to each other with the point of intersection being at the central point of the hub 20. As shown in FIG. 5, the "intersecting" corners of respective edges may not actually touch but may instead be truncated to accommodate the body of the hub 20. The partitions 18 of one desk 16 generally project directly back from the ends of the front edges and may be parallel to each other. The open space between the partitions 18 of a cubicle 12 define where the desk 16 is positioned between. And the space behind the desk 16 is the open space for a user to sit/stand (for example, area 32 as shown in FIGS. 8 and 9). The partitions 18 of adjacent cubicles 12 may be coupled together at an intersection defined by an obtuse angle. See for example, FIGS. 1 and 5. As may be appreciated, the angle between partitions 18 of adjacent cubicles may define an open space convenient for use of storage elements. Storage elements may include shelving, hanging tools such as pockets, and other items that can be attached to the partitions 18 usable for storing items. As shown throughout the figures, embodiments may include supporting corner brackets 22 and L-brackets 23 at the various intersections of desks 16 and partitions 18.

In some embodiments, the hub 20 includes a conduit for receiving electrical wiring that is connectable to electrical elements carried by the desks 16 (for example, computers or other electronics) or elements integrated into the partitions 18 (for example, outlets, ports, etc.). In the illustrative embodiment shown, the conduit may comprise a plurality of faceplates 20A with openings through which wiring may pass through. The hub 20 may be stationary so that as the cubicles 12 (or desks 16) rotate, the faceplates 20A rotate in synch with the cubicles 12. In other embodiments, the conduit may run down the central axis of the hub 20 through a rotary connector 21 (for example, an electrical slip ring collector, a ring rotary electrical contact, a joint rotary connector commutator), so as the cubicle or desks 16 rotate, the wiring moves with the elements being rotated. While not shown, it will be understood that the source of power may be provided, for example, from a hardwired outlet at the bottom of the hub 20 (for example, an outlet on the floor or an extension cord hub on the floor or fed into the conduit).

Referring now to FIGS. 4-7, in an illustrative embodiment, the system 10 may be motorized to help rotate the desks 16. The system 10 may include for example, a motor assembly 24. The motor assembly 24 may be positioned proximate the bottom of the system 10, centralized between the cubicles 12 and in alignment with the central hub 20 above. The motor assembly 24 may include a housing module which may include channels arranged in a triple junction for receiving walls of respective cubicles 12 (See FIG. 6). In one illustrative embodiment, the motor assembly 24 may include one or more motors 26 that when operated, drive individual planetary gears 30 to rotate around a fixed sun gear 28. The sun gear 28 may be mounted to a fixed substrate as shown in FIGS. 6 and 7. as the gears 30 rotate around the sun gear 28, the housing receiving the cubicle walls turns, rotating the cubicles 12. The amount of rotation may be user controlled or may be based on pre-programmed intervals loaded into the control system.

Referring now to FIGS. 8 and 9, embodiments showing illustrative arrangements of multiple systems 10 positioned next to each other are shown. The arrangements in FIGS. 8 and 9 illustrate how the systems 10 may be controlled to provide various configurations for the user who would be in the area called out by reference numeral 32. While the edges of adjacent systems 10 are shown in near contact, it should be understood that systems 10 may be positioned with more clearance between adjacent corners of the partitions 18.

As will be appreciated, the systems 10 may be used to scale a workspace environment so that multiple users have multiple access to different desks 16. The embodiments show arrangements using three systems 10 that when positioned next to each other, define a user workspace opening 32 that has simultaneous access to two or more desks 16 from respective systems 10. In operation, the user may rotate a system 10 by either manually pushing for example, on a partition 18 to drive the movers 34 or by triggering the motor assembly 24 to rotate until the desk 16 that is wanted is in front of the workspace opening 32. By using one of the control systems options, (for example, remote, wireless touch screen, or phone app, the user may control rotation of the systems 10 to navigate between two workspaces or to storage spaces. In an illustrative embodiment, the control system rotates the cubicle in an increment of 120 degrees. To navigate between one workspace and one storage space the control system rotates in an increment of 60 degrees. To get in and out of the central area 32, the control system turns all units 30 degrees to allow comfortable space to enter or exit.

The user may rotate any one (or sometimes multiple) systems 10 to access different desks 16 of different systems 10 at the same time. So, a single user may have access to three desks 16 at any given instance. If that same user has control to rotate the systems 10, the user may have access of up to nine different desks 16 without having to leave the workspace 32. FIG. 8 represents a configuration that maximizes the available access to storage elements. FIG. 9 maximizes a user's access to desks 16. However, the control system may be operated to rotate respective systems 10 so that any combination of desks 16 or storage areas may face the user. As may be appreciated, the number of combinations possible between three systems 10 may be on the order of $3^6$.

Figure 10:
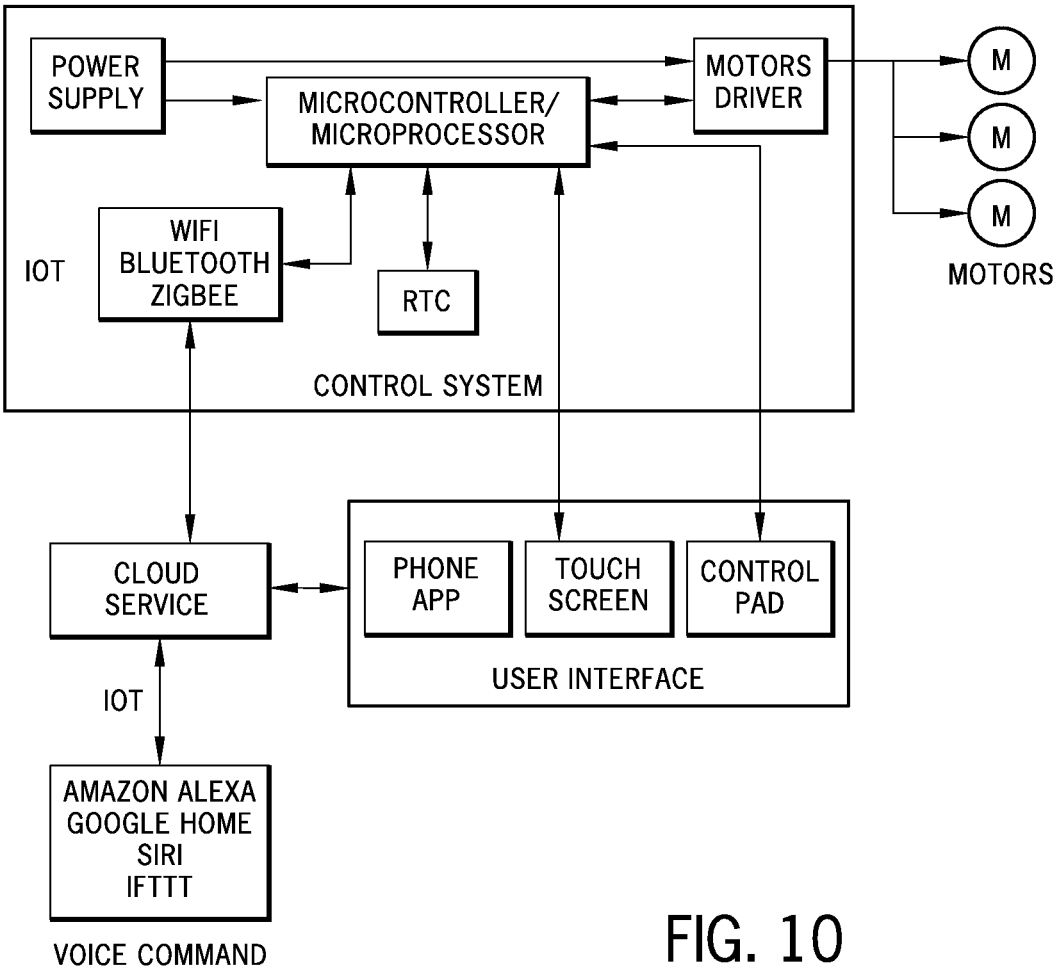
FIG. 10 is a block diagram of a control system for operating a geometric workspace system according to an embodiment of the subject technology.

Referring now to FIG. 10, a control system for operating a geometric workspace system is shown according to an embodiment. The control system may generally include a microcontroller or microprocessor that coordinates commands to the control system and commands to the motors of the system 10 via motor drivers. A user interface connected to the microcontroller or microprocessor may be for example, a smart phone or computing tablet application (via wireless connection) or a touch screen or a control pad, either of which may be part of hardware connected to the system 10. Some embodiments may include a wireless receiver in the control system. Some embodiments may connect to a cloud service to provide communication between the phone application and the wireless receiver. Some embodiments may be controlled by voice command through a smart hub device. In operation, users can select any space out of, for example, six spaces for each unit by clicking on the space name or picture on the smartphone app or the touch screen. Users can click right/left buttons on the user interface to rotate each unit right/left. In some configurations, the rotation of the system 10 opens a space up for users to enter into the area that faces multiple systems 10 simultaneously. Users can name/rename each space and customize the look of the spaces. Users can add more units to the control system and control them as well. Users can use virtual assistance such as Alexa®, Siri®, or Google® to control the units and select the space desired. In addition, users can use local control buttons that control the space's rotation for each unit. Users can control and monitor add-ons to the system such as lighting etc. through the control system user interface.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

Persons of ordinary skill in the art may appreciate that numerous design configurations may be possible to enjoy the functional benefits of the inventive systems. For example, while embodiments showed three systems 10 arranged together, other embodiments contemplated may include only two systems 10. Likewise, more than three systems 10 may be arranged to provide additional workspaces and the opening 32 would have a different shape depending on how many systems 10 were sharing a common workspace opening 32. Thus, given the wide variety of configurations and arrangements of embodiments of the present invention the scope of the invention is reflected by the breadth of the claims below rather than narrowed by the embodiments described above.

What is claimed is:

1. A furniture system for efficiently using workspace area, comprising:

a plurality of desks, wherein the plurality of desks includes at least three desks;

a hub positioned centrally between the plurality of desks, wherein the desks are coupled to the hub;

first and second desk edges on each desk, wherein the first and second of desk edges are:

coupled respectively to the hub, and positioned relative to each other, at a 120 degree angle as defined from a central point of the hub;

a first partition disposed vertically orthogonal with the first desk edge;

a second partition disposed vertically orthogonal with the second desk edge, wherein:

the partitions define an area of open space behind each desk, and the first partition of a first desk intersects a second partition of a second desk at a 120 degree angle;

a conduit in the hub configured to receive electrical wiring used by electrical components on the respective desks; and a mover coupled to at least one of the desks, wherein the plurality of desks are configured to rotate around the hub via the mover.

2. The system of claim 1, wherein the mover is one of a wheel, a caster, or a roller.

3. The system of claim 1, further comprising a motor coupled to the hub, wherein the motor drives a rotation of the plurality of desks around the hub.

4. A furniture system for efficiently using workspace area, comprising:

a first cluster of desks;

a first hub positioned centrally between the first cluster of desks, wherein the desks in the first cluster of desks are coupled to the first hub;

a first pair of desk edges on each desk, wherein the first pair of desk edges are:

coupled respectively to the first hub, and positioned relative to each other, at a 120 degree angle as defined from a central point of the first hub;

a first conduit in the first hub configured to receive electrical wiring used by electrical components on the respective desks of the first cluster of desks;

a first mover coupled to at least one of the desks of the first cluster of desks, wherein the first cluster of desks are configured to rotate around the first hub via the first mover;

a second cluster of desks positioned adjacent the first cluster of desks;

a second hub positioned centrally between the second cluster of desks, wherein the desks in the second cluster of desks are coupled to the second hub;

a second pair of desk edges on each desk, wherein the second pair of desk edges are:

coupled respectively to the second hub, and positioned relative to each other, at a 120 degree angle as defined from a central point of the second hub;

a second conduit in the second hub configured to receive electrical wiring used by electrical components on the respective desks of the second cluster of desks;

a second mover coupled to at least one of the desks of the second cluster of desks, wherein the second cluster of desks are configured to rotate around the second hub via the second mover, and wherein:

one of the desks of the first cluster of desks is positioned adjacent to one of the desks of the second cluster of desks for a user to access the one of the desks of the first cluster of desks and simultaneously access the one of the desks of the second cluster of desks; and a first motor coupled to the first hub, wherein the first motor drives a rotation of the first cluster of desks around the first hub, 30 degrees.

5. The system of claim 4, wherein the first mover or the second mover is one of a wheel, a caster, or a roller.

* * * * *